United States Patent [19]

Pilvet

[11] 4,111,018

[45] Sep. 5, 1978

[54] CARD OPERATED LOCK ASSEMBLY

[76] Inventor: Aksel Pilvet, R.R. #2, Warsaw, Ontario, Canada

[21] Appl. No.: 824,811

[22] Filed: Aug. 15, 1977

Related U.S. Application Data

[63] Continuation-in-part of Ser. No. 748,482, Dec. 8, 1976, abandoned.

[51] Int. Cl.[2] ..... E05B 21/00

[52] U.S. Cl. ..... 70/352; 70/387; 70/364 A; 70/384

[58] Field of Search ..... 70/350, 352, 363, 364 A, 70/387, 384, 421, 419

[56] References Cited

U.S. PATENT DOCUMENTS

| | | | |
|---|---|---|---|
| 2,656,707 | 10/1953 | Nilsson | 70/352 |
| 3,599,455 | 8/1971 | Pilvet | 70/363 |
| 3,654,783 | 4/1972 | Sinclair | 70/349 |
| 3,780,548 | 12/1973 | Anastasov | 70/352 |

*Primary Examiner*—Robert L. Wolfe

[57] ABSTRACT

The specification describes a lock and coded key for operating the lock. The lock comprises a housing having a keyhole, a rotatable actuating member, a locking mechanism provided with a lockable portion moveable from a locking position to an unlocking position, first locking means, second locking means, a pusher member for pushing the key into contact with the first locking means, and a locking member. The lockable portion is normally held in the locking position by the first locking means. The second locking means is normally in a release position but is arranged so as to lock the lockable portion in its locking position when a key bearing an incorrect code is inserted in the lock. The key is coded to move the first locking means to a release position without disturbing the second locking means. The lockable portion is tensioned to move to the unlocking position when both the first and second locking means are in a release position. The actuating member is adapted to operate the locking member when the lockable portion is in its unlocking position. The actuating member is also adapted to return the lockable portion to its locking position.

16 Claims, 15 Drawing Figures

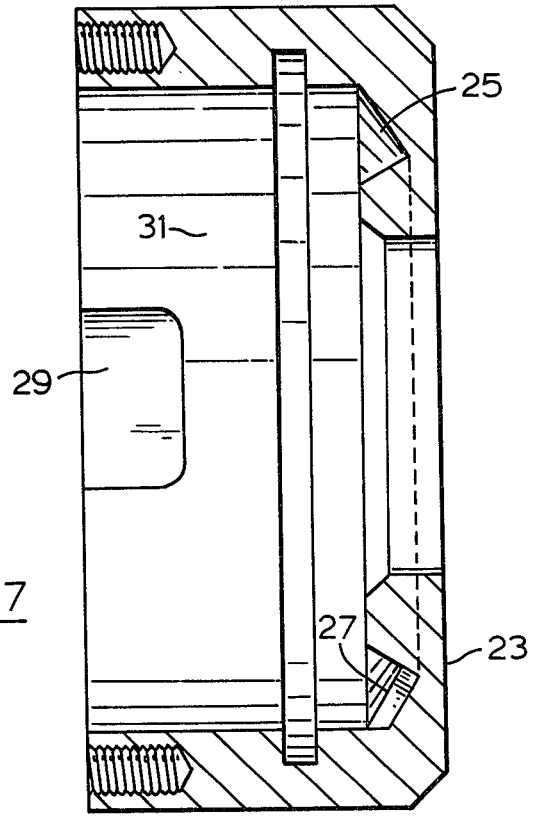
FIG. 7
FIG. 8
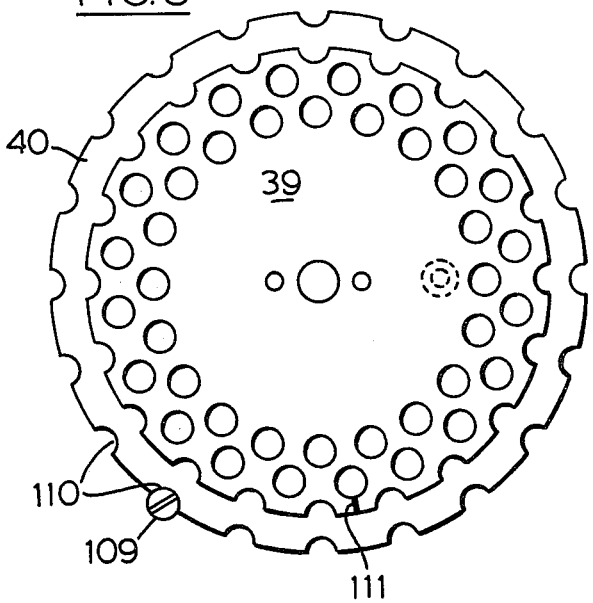

CARD OPERATED LOCK ASSEMBLY

This is a continuation-in-part application of U.S. Pat. application Ser. No. 748,482 filed Dec. 8, 1976 and now abandoned.

FIELD OF THE INVENTION

This invention relates to a new and improved type of locking mechanism and a coded key for activating that locking mechanism.

BACKGROUND OF THE INVENTION

The major drawback of existing key operated locks is that they are susceptible to being opened or picked by unauthorized persons. A person desiring to pick a lock can simply insert a foreign object or tool into the keyhole and thereby determine the location of the locking pins or tumblers by feeling with the foreign object until an area of resistance is encountered. This area of resistance indicates the position of the tumbler and once that position has been determined, the locking pin or tumbler can be moved to an unlocking position. As each tumbler is uncovered, it can be moved to an unlocking position and held their until all the locking tumblers or pins have been released. Look more specifically at a locking arrangement, such as that found on most doors which includes a rotatable doorknob for moving a bolt or latch from a locking position to an unlocking position, it should be noted that the doorknob is secured against rotation through direct contact with the tumblers. Therefore, force can be applied directly on the tumblers. Therefore, force can be applied directly on the tumblers which resist rotation of the doorknob. This resistance provides a means of feeling the arrangement of locking tumblers and accounts for the fact that existing locks are susceptible to picking. As each tumbler is released, it is wedged in its release position by rotation of the doorknob until all the tumblers have been released.

Furthermore, in considering existing lock structures it is generally the case that when a new locking arrangement is required, it is easier to replace the lock than to relocate the tumblers within the lock because the tumblers are usually permanently fixed therein.

The present invention provides a lock and coded key for operating that lock. The lock comprises a housing having a keyhole, a rotatable actuating member, a locking mechanism provided with a lockable portion moveable from a locking position to an unlocking position, first locking means, second locking means, a pusher member for pushing the key into contact with the first locking means, and a locking member. The lockable portion is normally held in its locking position by the first locking means. The second locking means is normally in a release position but is arranged so as to lock the lockable portion in its locking position when a key bearing an incorrect code is inserted in the lock. The tumblers prevent movement of the locking member through the actuating member by means of the lockable portion making it essentially impossible to pick the tumblers because they cannot be felt by moving the actuating member.

The key itself is coded to move the first locking means to a release position without disturbing the second locking means. The lockable portion is tensioned to move to its unlocking position when both the first and second locking means are in a release position. The actuating member is adapted to both operate the locking member when the lockable portion is in its locking position and to return the lockable portion to its locking position.

BRIEF DESCRIPTION OF THE DRAWINGS

The above mentioned as well as other advantages and features of this invention will become apparent in the following detailed description of the preferred embodiments wherein:

FIG. 7 has the sectional view of a lock housing for housing the lock shown in the earlier Figures;

FIG. 8 is a frontal view of the lockable portion of the rotating mechanism of FIG. 3 according to a preferred embodiment of this invention;

DETAILED DESCRIPTION OF THE PREFERRED EMBODIMENTS

Figure 2:
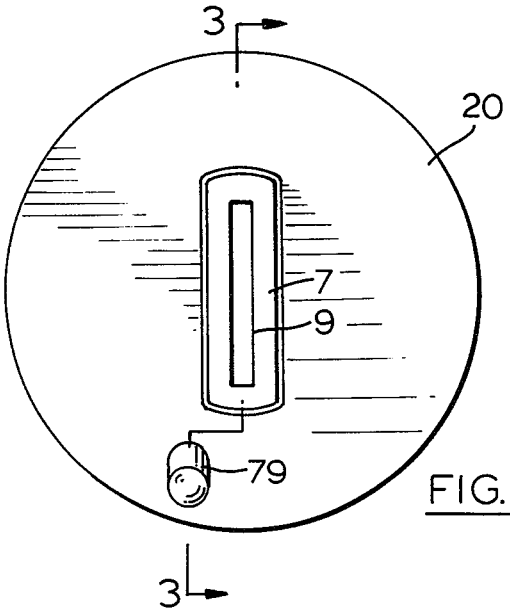
FIG. 2 is a frontal view of a preferred embodiment of a lock when removed from its lock housing according to this invention.
Figure 1:
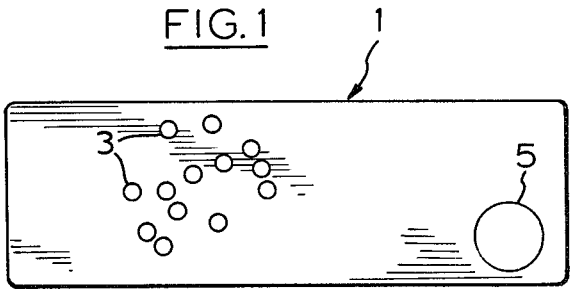
FIG. 1 is a side view of a coded key according to this invention.
Figure 3:
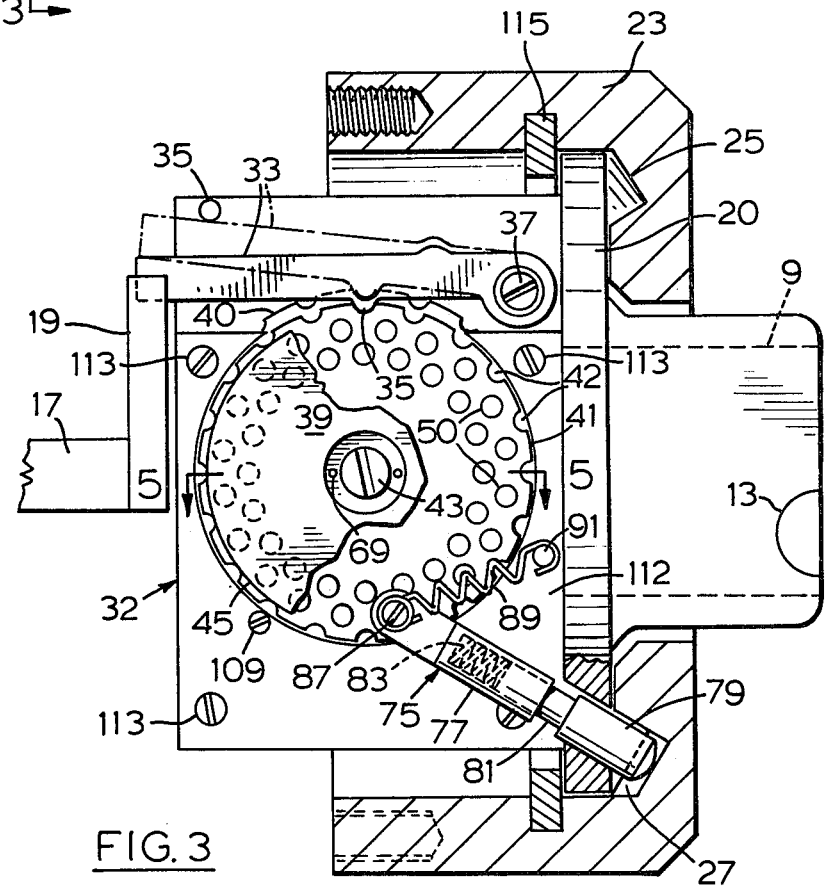
FIG. 3 is a sectional view taken along the lines 3—3 of FIG. 2 showing the lock in its housing.
Figure 4:
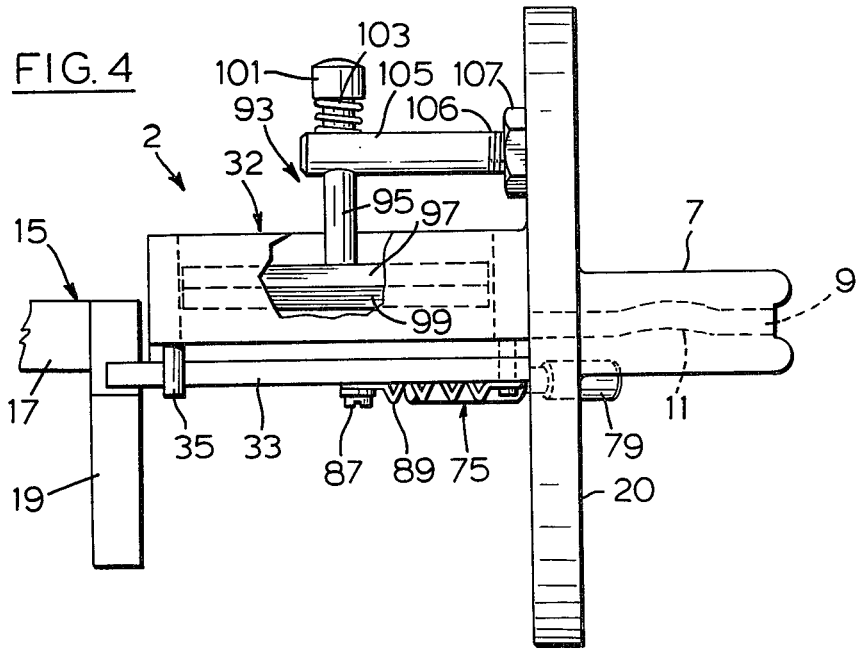
FIG. 4 is a side view of the lock of FIG. 2.

A coded key 1 shown in FIG. 1 is used for operating a lock generally indicated at 2 as best shown in FIGS. 3 and 4. Key 1 is in the form of a card constructed of a resilient material preferably a plastic such as polyethylene. The key card is coded by means of perforations 3, the function of which will be described hereinafter. The perforations can be replaced by indentations which do not extend all the way through the key. Key card 1 also includes an indicator mark 5 which aligns with a corresponding indicator mark 13 provided on lobe 7 to show how the key card should be inserted into the lock. As best shown in FIG. 4, the lock includes a latch or catch mechanism generally indicated at 15 and a locking mechanism in the form of a barrel assembly generally indicated at 32 which rotates with lobe 7.

Lobe 7 includes a key card insert in the form of slot 9, which extends through barrel flange 20 to the interior of barrel assembly 32. In this embodiment, slot 9 includes a curved portion 11 to provide a sight break to the interior of the lock. The key card is constructed of the resilient material as mentioned above to allow insertion of the card through the curved slot without permanently deforming the card.

Latch mechanism 15 includes a latch bar 17 and a latch lever 19. Latch bar 17 is moved in and out of a locking position by rotating lobe 7 when barrel assembly 32 is coupled to latch mechanism 15.

Barrel assembly 32 is housed in lock housing 23 which is best shown in FIG. 7. Lock housing 23 includes channel 25 provided with camming portion 27 as well as central hollow portion 29 and solid portion 31.

Figure 5:
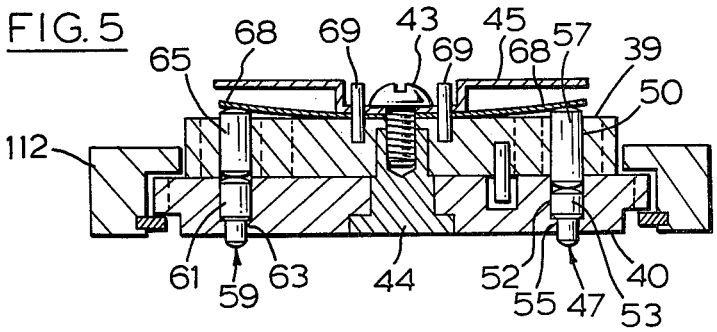
FIG. 5 is the sectional view taken along the lines 5—5 of FIG. 3.

Barrel assembly 32 includes a coupling rod or clutch lever 33 provided with a radial extension or protrusion 35. Clutch lever 33 pivots about screw 37 as shown in FIG. 3. Located below clutch lever 33 is a first disc 39. Referring to FIG. 5, first disc 39 is in rotatable engagement with a second disc 40 having a larger diameter than the first disc. The first and second discs form part of the barrel assembly and the locking disc 39 is moveable from a locking position to an unlocking position. The two discs are secured to one another by means of bolt 43 and nut 44. Returning to FIG. 3 it can be seen that first disc 39 has a plurality of indentations 42 located at the outer periphery 41 of the disc.

Figure 6:
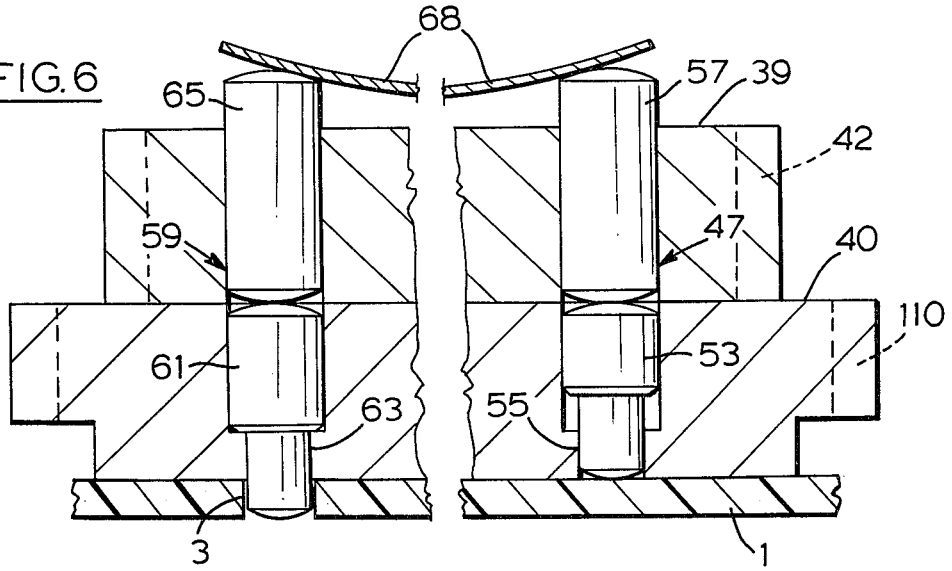
FIG. 6 is an enlarged view similar to FIG. 5 when the coded key of FIG. 1 is inserted into the lock.

As best shown in FIG. 6, first disc 39 and second disc 40 include apertures 50 and 52 respectively. The apertures on each disc are aligned to provide passages extending through both discs. A first set of tumblers 47 are fitted into some of the passages and a second set of tumblers 59 are fitted into others of the passages.

First set of tumblers 47 include a number 1 length tumbler 53 and a number 4 length tumbler 57. Second set of tumblers 59 include a number 2 length tumbler 61 and a number 3 length tumbler 65. The tumblers increase in length ranging from the number 1 length tumbler which is the shortest tumbler to the number 4 length tumbler which is the longest tumbler. As can be seen from FIG. 6, the tumblers are precluded from falling out of the passageways by the provision of side wall portion 55 on tumbler 53 and side wall portion 63 on tumbler 61 which mate with portions 56 of apertures 52. Provided adjacent the outer end of tumblers 57 and 65 is a leaf spring 68 which tends to force both sets of tumblers to abut walls 56 of apertures 52. Located outwardly of leaf spring 68 is a cover washer 67 which limits the outward movement of leaf spring 68 and prevents the tumblers from being forced completely out of the apertures. Cover washer 67 and leaf spring 68 are held in place by locating pins 69.

Referring to FIG. 3 the barrel assembly includes an extendable arm or rod 75, which includes a hollow sleeve portion 77 and a nylon tipped rod end 79. Nylon tipped rod end 79 is provided with a rod portion 81 slidably engaged in hollow sleeve portion 77. Rod portion 81 abuts spring 83 located in the interior of the sleeve. The extendable rod functions in much the same manner as would a shock absorber. The sleeve 77 is secured to disc 39 by means of screw 87 while nylon tipped rod end 79 extends through barrel flange hole 21 into channel member 25 of housing 23. Screw 87 also secures one end of spring 89 to disc 39. The other end of spring 89 is secured to barrel plate 112 by means of post 91.

Turning to FIG. 4, the lock also includes a pusher plate assembly 93 provided with rod portion 95 and rigid pusher plate 97 having a rubber padding 99 on its outer surface. Located at the other end of rod portion 95, is a nylon tip 101. The pusher plate assembly is secured to the barrel assembly by means of apertured securing arm 105 having a thread 106 for threaded engagement with nut 107 secured to barrel flange 20. Rod portion 95 is fitted through the aperture of securing arm 105 with spring 103 located between the securing arm and nylon tip 101.

As shown in FIG. 3, the lock includes a combination change screw 109 which is screwed into the barrel plate and which is fitted into an indentation located on the periphery of disc 40. Disc 40 as shown in FIG. 8 is located behind the barrel plate which fits between the two discs to secure them in the barrel assembly. Disc 40, which as earlier mentioned has a larger diameter than disc 39, includes combination change steps 110. Disc 39 is provided with a combination indication marker 111, the position of which is recorded to indicate the various combinations that have been used. The barrel assembly is held together by means of screws 113 and the housing is secured about the barrel assembly by means of assembly ring 115.

The lock according to this embodiment functions in the following manner. Prior to inserting key card 1 into the lock or when key card 1 is removed from the lock, lobe 7 will not operate the latch mechanism 15 due to the fact that disc 39 is secured in its locking position as shown in FIG. 5 by means of first set of tumblers 47. Second set of tumblers 59 are normally in a non-locking position, such that the inner surface of number 2 tumbler 61 and number 3 tumbler 65 are located at the interface or sheer plane between the two discs. Therefore, first set of tumblers 47 preclude relative movement of discs 39 and 40. Moreover, the barrel assembly is completely and freely rotatable of the latch mechanism because clutch lever 33 does not engage latch lever 13 due to the provision of protrusion 35 on the clutch lever. Protrusion 35 rests on one of the non-indented portions 41 located at the periphery of disc 39. When lobe 7 and barrel assembly 32 are rotated, the orbit of clutch lever 33 is beyond the outer end of the latch lever with protrusion 35 resting on the non-indented portion of the periphery of disc 39. This abutting relationship is maintained as long as the two discs are locked relative to one another by either the first or second set of tumblers.

In order to operate the latch mechanism, resilient key card 1 provided with combination holes or perforations 3 is inserted into slot 9 of lobe 7. Indicator mark 5 of key card 1 must align with indicator 13 of lobe 7 in order to properly fit the key card in the lock. The key card is resilient and therefore will easily fit around curved portion 11 of slot 9 without permanently deforming the shape of the kye card. The key card can only be inserted into the lock when lobe 7 is at a zero position, because when it is in this position nylon tip 101 of pusher plate assembly 93 is located in hollow 29 of the lock housing. As the lobe is rotated away from the zero position, nylon tip 101 cams out of the hollow 29 onto solid portion 31 of the housing. As the nylon tip is rotated out of the hollow, spring 103 of the pusher plate assembly is compressed and rod portion 95 forces pusher plate 97 provided in this embodiment with protective rubber padding 99 to a position where it blocks the end of the card insert so that the key card cannot be inserted into the interior of the barrel assembly. It is only when nylon tip 101 is located in hollow 29 that the key card can be fully inserted into the lock and this as mentioned above, is the zero position. The zero position is marked on the lock housing.

With the key card properly inserted in the lock, the lobe is rotated to force pusher plate assembly 93 and more specifically rubber padding 99 to abut the key card as described below. The key card is thereby moved to the position shown in FIG. 6. As can be seen the solid portion of the key card abuts the end of number 1 length tumbler 53 and forces it to move toward disc 39. Tumbler 53 in turn forces tumbler 57 to move to a location such that the inward edges of tumblers 53 and 57 are located along the interface between discs 39 and 40. Tumbler 57 forces leaf spring 68 away from disc 39. However, as earlier mentioned, tumbler 57 cannot be completely pushed out of the aperture 50 due to the provision of cover washer 67.

At the same time that the solid portion of the key card is forcing first set of tumblers 47 to a non-locking or release position, the perforations 3 on the key card must engage with second set of tumblers 59 such that the ends of tumblers 61 protruding from disc 40 fit in the apertures. As can be appreciated from the drawings there can be numerous first and second sets of tumblers and therefore apertures 3 on key card 1 must be arranged such that they engage all of the non-locking tumblers with the solid portion of the key card abutting all of the locking tumblers in order to move the locking tumblers to a release position without disturbing the non-locking tumblers.

As can be seen from the drawings, nylon tipped rod end 79 of extendable rod 75 which rotates with barrel assembly is secured in channel 25 of housing 23. When in the zero position, nylon tipped rod end 79 sits on embossed or camming portion 27 of channel 25 thereby compressing spring 83 and attempting to push disc 39 in a clockwise direction. When the rod is rotated with the barrel assembly nylon tipped rod end 79 overrides camming portion 27 and spring 83 expands or elongates. When the nylon tipped rod end is out of engagement with the camming portion, spring 89 tends to pull disc 39 in a counterclockwise direction. It must be remembered that disc 40 is secured against rotation by means of combination change screw 109 and relative movement of the discs is prevented by first set of tumblers 47 prior to inserting the proper key card into the lock. However, when the key card is inserted and the lobe is rotated, such that extendable rod 75 cams out of engagement with portion 27 and first set of tumblers 47 have been moved to a release position, spring 89 is secured to disc 39 by means of screw 87 and secured to barrel plate 112 by means of stud 91 will in fact rotate disc 39 in the counterclockwise direction. The amount of rotation of disc 39 is limited to half an increment, i.e. half the distance between the indented portions provided about the periphery of disc 39 by means of limit pin 71 which is secured to disc 39 and which extends into aperture 73 of disc 40.

When the locking tumblers have been released, disc 39 will rotate half an increment relative to disc 40 and protrusion 35 of clutch lever 33 then lies directly over one of the indented portions 42 of disc 39. Under gravity, the clutch lever falls into a coupling position with the protrusion fitted in one of the indented portions. When the clutch lever falls, the radius of the orbit of rotation at the end of the clutch lever is decreased to the extend that it engages with the end of latch lever 19. When the two levers are thusly engaged the latch mechanism can be moved from a locking to an unlocking position by simply rotating lobe 7.

In order to remove key card 1 from the lock, lobe 7 is rotated in a direction opposite to that described above. As the lobe is returned to the zero position, pusher plate assembly 93 is forced away from the key card by means of spring 103 and at the zero position nylon tip 101 resumes its position in hollow 29 of housing 23. Also as the lobe is rerotated, nylon tipped rod end 79 rides over and rests on camming portion 27 of channel 25 to compress spring 83. Spring 83 in turn tends to force disc 39 to rotate in the clockwise direction and to override the pressure applied in the counterclockwise direction by spring 89 so that disc 39 is returned to the locking position. The first set of tumblers 47 are then moved to the locking position by means of leaf spring 68. As the first set of tumblers are moved to the locking position, the protruding end of tumbler 53 forces key card 1 to move away from disc 40 to the extent that tumblers 61 are no longer engaged by apertures 3 of key card 1 and the key card can be removed from the lock simply by pulling it out of slot 9. When the lobe has been rerotated and the card has been removed, protrusion 35 of lever 33 once again rides on the unindented portion of the periphery of disc 39, such that the clutch lever is uncoupled from the latch lever and the barrel assembly is completely and freely rotatable of the latch mechanism.

As can be appreciated from the above description, disc 39 must be released from disc 40 in order to permit clutch lever 33 to fall and to couple with latch lever 19. This means that the first set of tumblers 47 must be released and at the same time the second set of tumblers 59 must be maintained in the releasing position. The location of both sets of tumblers can be rearranged by simply removing combination change screw 109 as well as screw 87, rotating the two discs a full increment or more and replacing the combination change screw such that it engages a combination step at the periphery of disc 40. The combination can also be changed by separating the two discs and inserting the tumblers in a new combination of apertures within the two discs. As shown in FIG. 8, the two discs can be provided with more than one row of apertures so that the tumblers can be inserted in either an inner or outer row of apertures. Furthermore, the apertures can be arranged in an irregular manner such as an elliptical arrangement so that the possible number of positions or locations for the first and second set of tumblers is almost limitless and the method of rearranging the locations is a very simple operation. The combinations which have been used are recorded by means of location mark indicator 111 so that the same combination is not advertently used again. When the combination is changed, the new combination is recorded and a new key card having a new combination of apertures and solid portions is stamped by a stamping machine.

As can be appreciated, it is essentially impossible to pick the lock described above because prior to insertion of a properly coded key card, the barrel assembly is completely and freely rotatable of the latch mechanism so that there are no pressure points for feeling the position or location of the tumblers. Nor is it possible to visually determine the location of the tumblers due to the provision of the sight break in the key card slot. The sight break also precludes the insertion of most unauthorized tools into the lock's interior.

According to another aspect of the embodiment described above, leaf spring 68 is eliminated and each set of tumblers in provided with its own spring which would abut a cover washer similar to that shown in FIG. 5 located directly adjacent the outer surface of disc 39.

The clutch lever shown in the drawings is moved from an uncoupling to a coupling position due to gravity and therefore the lock is mounted such that clutch lever 33 is located above the latch lever when the first disc is released from the second disc. However, the clutch lever can also be spring loaded so that it will engage the latch lever when the smaller disc is released regardless of the clutch lever's orientation, i.e., the clutch lever could be positioned below the latch lever and still couple to the latch lever when spring loaded.

FIGS. 9 through 15 show an alternative embodiment according to this invention. The lock includes lobe 162 and housing 168 which houses the internal components of the locking mechanism generally indicated at 150 in FIG. 9. Key card 152 includes indicator marker 154, apertures 158, and indented portions 160 which do not extend all the way through the card. According to preferred specifications, housing 168 has a maximum diameter of 17 mm.

Housing 168 includes threaded mounting holes 169, internal depression 170, a cutaway portion generally indicated at 172, and camming surface 178. Surfaces 174 and 176 define the boundaries of the cutaway portion.

Figure 11:
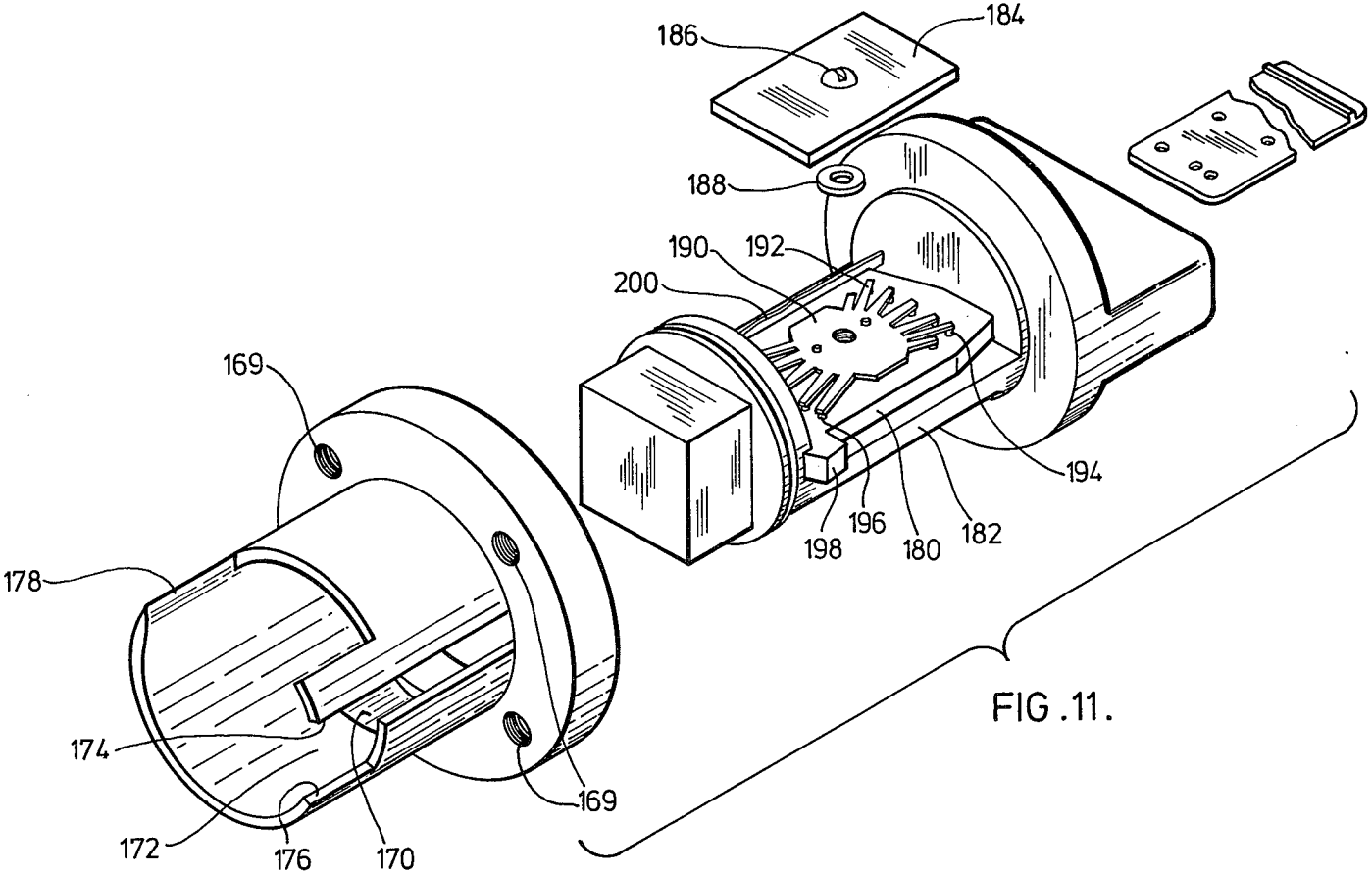
FIG. 11 is an exploded elevational view looking down on the lock structure of FIG. 9 when rotated through an angle of 180°.
Figure 14:
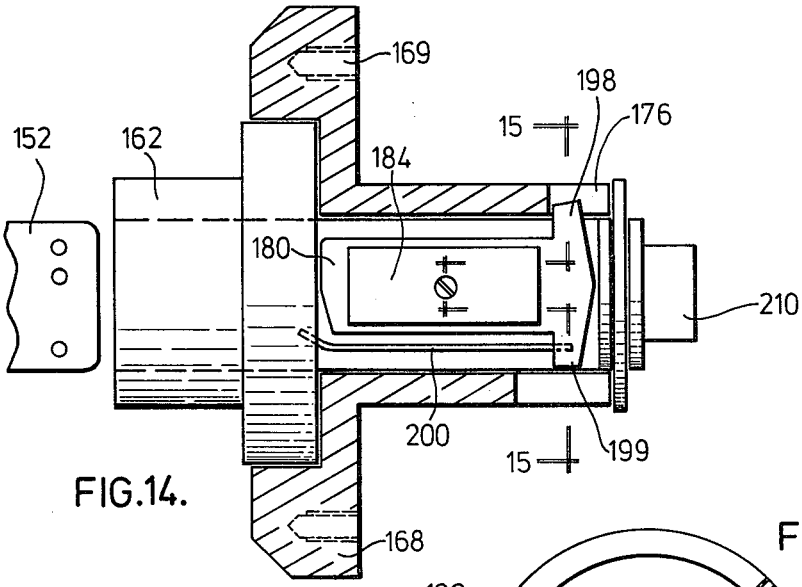
FIG. 14 is a side elevational view of a lock with the coded key removed and the lockable portion in the locking position.

The locking mechanism enclosed within the housing includes a moveable plate 180 provided with lugs 198 and 199. The plate is mounted for pivotal movement to a supporting surface 182 by means of screw 186 extending through mounting plate 184. (It could of course be mounted such that it shifts to the unlocking position). Secured between the two plates are washer 188 and spring 190 provided with a plurality of outwardly extending arms 192 as best shown in FIG. 11.

Figure 15:
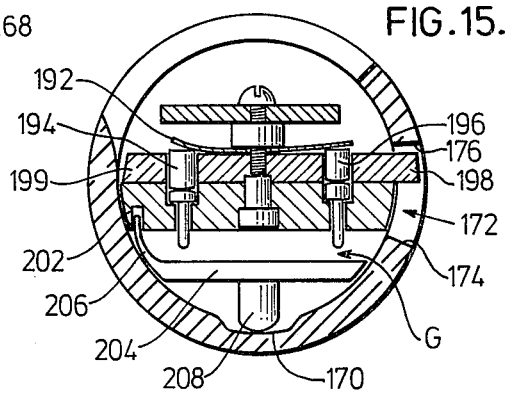
FIG. 15 is a sectional view taken along the lines 15—15 of FIG. 14.
Figure 12:
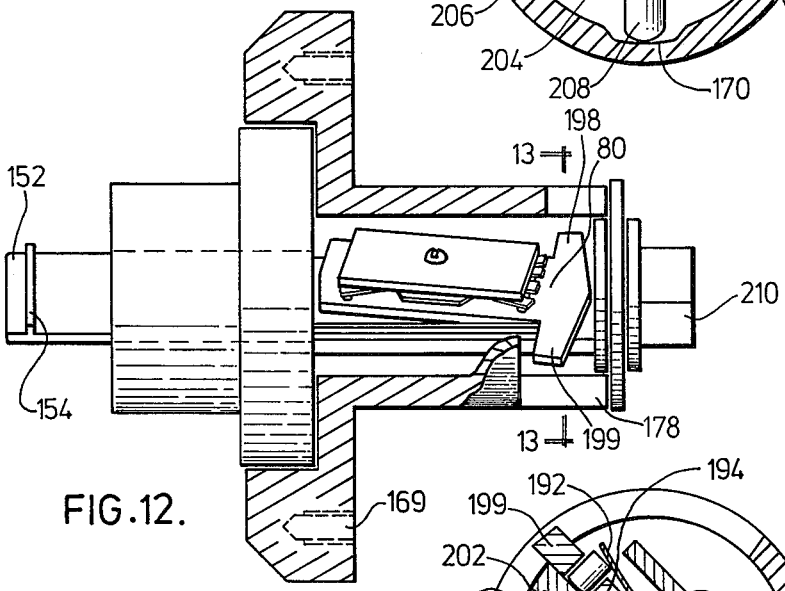
FIG. 12 is a side elevational view showing an assembled lock structure with a coded key inserted therein with the lockable portion in the unlocking position.

Plate 180 is provided with a plurality of perforations aligned with an equal number of perforations provided in supporting surface 182. Tumblers 194 and 196 are secured within the aligned perforations of the plate and the supporting surface. Arms 192 maintain the tumblers within the aligned perforations as shown in FIG. 15. As will become apparent from that Figure, the tumblers cannot be removed from the mounting surface side of the locking mechanism due to their configuration.

Figure 9:
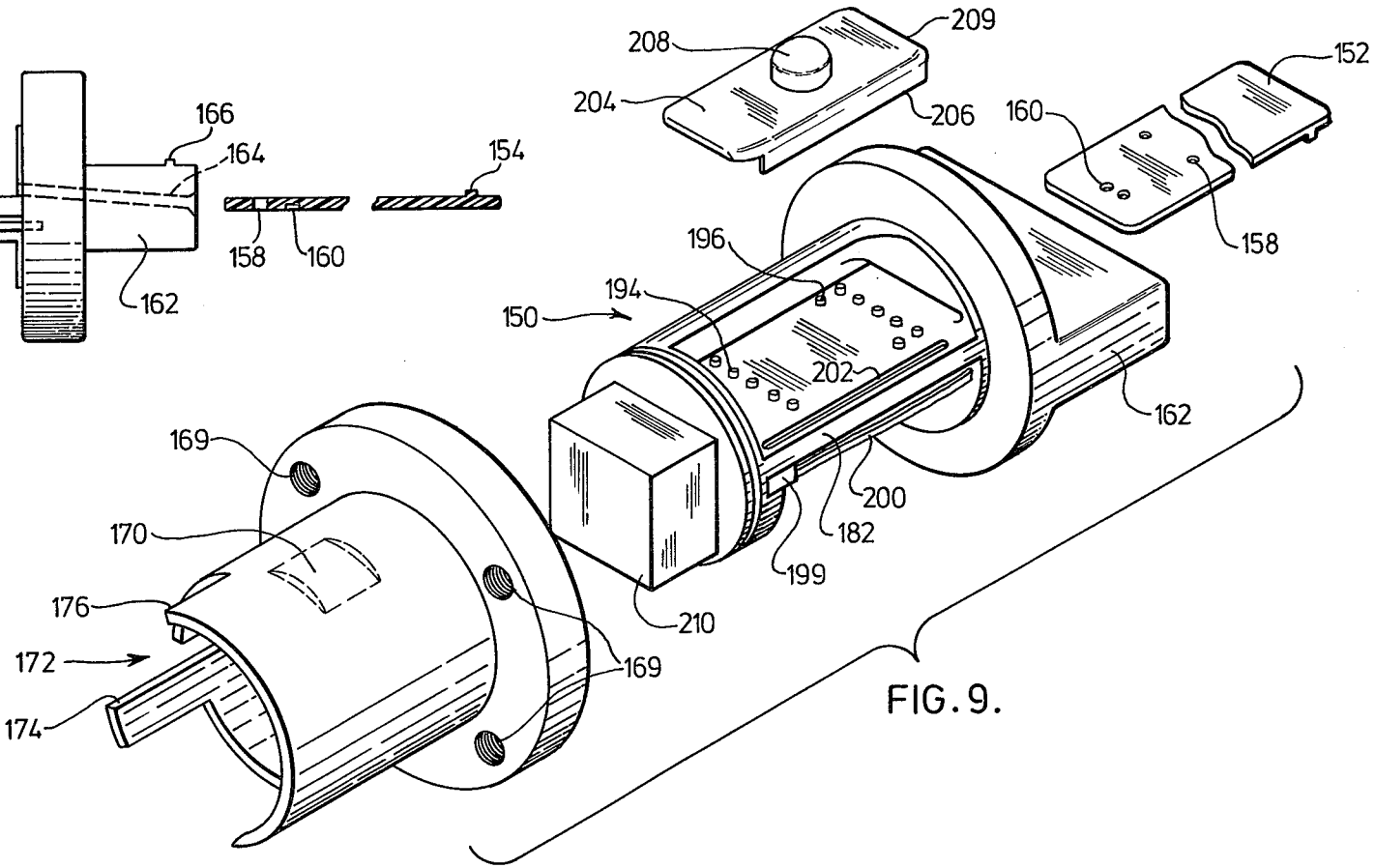
FIG. 9 is an exploded elevational view looking down on an alternative lock structure and coded key according to this invention.
Figure 10:
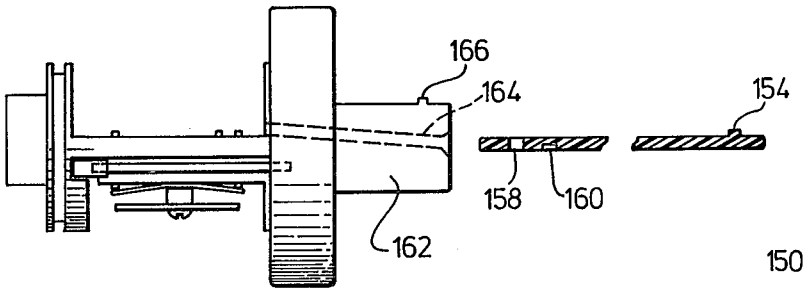
FIG. 10 is a side view of the arrangement shown in FIG. 9.

FIG. 9 shows the provision of spring 200 as well as pusher plate 204 provided with axial shoulder 206 and boss 208. Shoulder 206 fits within a groove 202 provided on the rear of the mounting surface when the lock is assembled. Spring 200 is arranged such that moveable plate 180 is tensioned at all times to move to an unlocking position. Prior to insertion of a properly coded key into the lock, plate 180 is held in its locking position by tumblers 194 as shown in FIG. 15.

Provided at the end of the lock remote from actuating lobe 162 is a connecting member 210 used for connecting the lock to a latch mechanism. (not shown)

As best shown in FIGS. 11 and 15 when plate 180 is in its locking position, lug 198 protrudes beyond mounting surface 182 such that it is trapped between surfaces 174 and 176 of the restraining cutaway area 172. Therefore, when the plate is in this locking position, the lock is restricted in its rotational movement such that a latch mechanism connected to the lock cannot be operated.

In order to move plate 180 to the unlocking position, properly coded key 152 is inserted through key card insert 164 when the lock is in the zero position. Indicator 154 provided on the key card is aligned with indicator 166 provided on the lobe to determine the proper orientation of the card. Although it cannot be seen from the drawings, the forward edge 209 of the pusher plate is bevelled for ease of insertion of the card within the lock. As shown in FIG. 15, when the lock is in the zero position, boss 208 is located in depression 170 such that there is a gap G provided between the protruding ends of the tumblers and the inner surface of the pusher plate. The key card fits within this gap.

After the key card has been fully inserted into the lock, lobe 162 is rotated and the locking mechanism rotates with the lobe. Boss 208 cams out of depression 170 into contact with the inner wall of the housing. The pusher plate pushes on the key card such that tumblers 194 move to a release position whereby the shear plane of the tumblers aligns with the interfaces of plate 180 and mounting surface 182. As can be seen from FIG. 13, the ends of tumblers 194 fit within the indentations 160 provided on the key card. Tumblers 196 fit within the perforations 158 provided on the key card such that those tumblers remain in a release position. The lock could of course be provided with a third set of tumblers similar to tumblers 47 provided in the earlier described embodiment. These tumblers would abut the solid portion of the key card.

Figure 13:
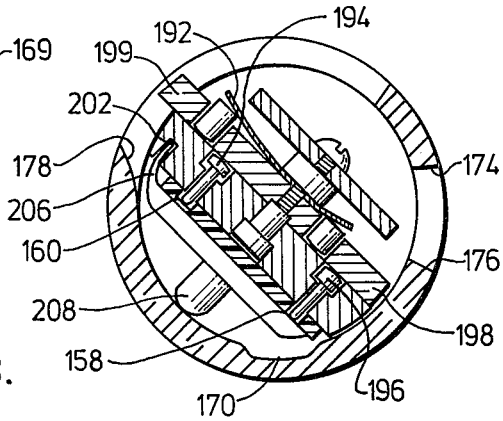
FIG. 13 is a sectional view taken through the lines 13—13 of FIG. 12.

When the tumblers are in the positions shown in FIG. 13, plate 180 pivots under the tension of spring 200 about screw 186 to the unlocking position. As can be seen from FIGS. 12 and 13 when plate 180 has pivoted to the unlocking position, lug 198 moves to a position where it is no longer restrained within cutaway portion 172, thereby permitting rotation of the lobe and associated locking mechanism to the extent that a latch mechanism connected to the lock can be operated.

In order to return plate 180 to its locking position, the lobe is simply rerotated in the opposite direction and lug 199 cams over camming surface 178 thereby forcing plate 180 to move to the locking position against the tension of spring 200. When the lobe has been returned to the zero position, boss 208 is again located within depression 170 with lug 198 secured in cutaway portion 172.

According to an alternative form of the invention the pusher member simply comprises a plate adapted to permit insertion of the key card and tensioned to push the key card into contact with the locking tumblers. The key card would again include grooves or indentations which would engage the tumblers normally in a release position.

The restraining area used to restrict the movement of lug 198 need not comprise an entire cutaway area within the housing. It could be replaced by an internal channel presenting restricting surfaces to the lug when the plate is in its locking position.

In both of the embodiments described above, the tumblers maintain the lock in its locking position through the use of a moveable lockable portion. Therefore, the tumblers are not directly associated with the actuating member making it virtually impossible to feel the tumblers. Furthermore, the tumblers could be provided such that they are recessed within their respective perforations and the key card would then be provided with bossed portions which would penetrate the perforations for moving the tumblers to a release position. Under these circumstances, the sight break in the slot would not be required because nothing would be visual within the lock.

Again, according to this embodiment, the tumblers can easily be rearranged to provide for a new locking arrangement. Thus it can be seen that the lock and coded key according to this invention has tremendous ramifications in areas such as the hotel industry where it is desireable to quickly and easily change the lock and key for a hotel room which is used by numerous persons.

Although various preferred embodiments of the invention have been described herein in detail, it will be apparent to one skilled in the art that variations may be made thereto without deparding from the spirit of the invention or the scope of the apended claims.

The embodiments of the invention in which an exclusive property or privilege is claimed are defined as follows:

1. A lock and coded key for operating said lock, said lock comprising a housing having a key hole, a rotatable actuating member, a locking mechanism provided with a lockable portion moveable from a locking position to an unlocking position, first locking means, second locking means, a pusher member for pushing said key into contact with said first locking means, and a locking member, said lockable portion being normally held in said locking position by said first locking means, said second locking means normally being in a release position but being arranged so as to lock said lockable portion in said locking position when a key bearing an incorrect code is inserted in said lock, said key being coded to move said first locking means to a release position without disturbing said second locking means, said lockable portion being tensioned to move to said unlocking position when both said first and second locking means are in a release position, said actuating member being adapted to operate said locking member when said lockable portion is in said unlocking position and to return said lockable portion to said locking position.

2. A lock and coded key as claimed in claim 1 wherein said first and second locking means comprise sets of first and second locking tumblers and said coded key is a resilient key card provided with a plurality of indentations adapted to mate with said second locking tumblers when said resilient key card is inserted in said lock.

3. A lock and coded key as claimed in claim 2 wherein said locking mechanism rotates with said actuating member when said lockable portion is in said locking position and said lockable portion comprises a spring tensioned plate provided with a plurality of perforations in which the first and second locking tumblers are located.

4. A lock and coded key as claimed in claim 3 wherein said pusher member comprises a pusher plate.

5. A lock and coded key as claimed in claim 4 wherein said pusher plate is provided with an extension in camming engagement with said housing and said pusher plate rotates with said locking mechanism such that said pusher plate pushes said key card into engagement with said first locking tumblers with said indentations mating with said second locking tumblers upon rotation of said locking mechanism.

6. A lock and coded key as claimed in claim 4 wherein said pusher plate is tensioned to push said resilient key card into engagement with said first locking tumblers upon insertion of said key card into said lock.

7. A lock and coded key as claimed in claim 2 wherein said indentations extend completely through said key card.

8. A lock and coded key as claimed in claim 3 wherein said spring tensioned plate is provided with a lug extending from each side of said plate, one of said lugs extending into a restraining portion of said housing when said spring tensioned plate is in said locking position for precluding free rotation of said locking mechanism and being remote of said restraining portion when said spring tensioned plate is in said unlocking position, the other of said lugs being adapted to coact with a camming surface on said housing for moving said spring tensioned plate from said unlocking position to said locking position against the spring tension.

9. A lock and coded key as claimed in claim 2 wherein said key hole is in the form of a curved slot.

10. A lock and coded key as claimed in claim 8 wherein said spring tensioned plate is mounted for pivotal movement from said locking position to said unlocking position.

11. A lock and coded key as claimed in claim 2 wherein said locking mechanism includes a coupling member for coupling said locking mechanism to said locking member, said coupling member being maintained in an uncoupled position by said spring-tensioned plate when in said locking position so that said actuating member and said locking mechanism are freely rotatable of said locking member, said locking mechanism also being provided with coupling means for coupling said coupling member to said locking member when said spring tensioned plate is in said unlocking position.

12. A lock and coded key as claimed in claim 2 wherein said locking mechanism further includes a coupling member for coupling said locking mechanism to said locking member and said lockable portion is a generally rounded disc provided with a plurality of perforations in which said tumblers are located, said disc being mounted so as to pivot from said locking position to said unlocking position, said coupling member being in an uncoupled position when said disc is in said locking position and being in a coupling position when in said unlocking position.

13. A lock and coded key as claimed in claim 12 wherein said coupling member is a clutch lever provided with a radial extension and said disc includes a plurality of indentations spaced about its periphery, said radial extension abutting an unindented portion of said periphery when said disc is in said locking position and being adapted to fit into one of said indentations when said disc is in said unlocking poisiton for coupling said clutch lever to said locking member.

14. A lock and coded key as claimed in claim 13 wherein said locking mechanism includes a spring loaded extendible arm extending to said housing from said disc, said extendible arm being adapted to cam over a camming surface in said housing to move said disc to said locking position.

15. A lock and coded key as claimed in claim 3 wherein said perforations are arranged in an irregular pattern and said tumblers are readily relocated in different perforations to provide other arrangements of first and second locking means.

16. A lock and coded key as claimed in claim 12 wherein the position of said disc is readily altered to relocate said first and second sets of tumblers.

* * * * *